United States Patent [19]

Gregory

[11] Patent Number: 4,754,588

[45] Date of Patent: Jul. 5, 1988

[54] FOUNDATION PILING SYSTEM

[76] Inventor: Steven D. Gregory, 2400 S. Monta Vista, Ada, Okla. 74820

[21] Appl. No.: 67,722

[22] Filed: Jun. 26, 1987

[51] Int. Cl.[4] ..... E02D 27/00

[52] U.S. Cl. ..... 52/294; 52/698; 405/229

[58] Field of Search ..... 52/274, 292, 294, 293, 52/297, 296, 251, 252, 253, 260, 259, 698; 405/229, 230, 231, 255, 256, 257

[56] References Cited

U.S. PATENT DOCUMENTS

| | | | |
|---|---|---|---|
| 563,130 | 6/1896 | Breuchaud . | |
| 776,419 | 11/1904 | Platt . | |
| 926,497 | 6/1909 | Kahn | 52/253 |
| 1,086,678 | 2/1914 | Marsh | 405/678 |
| 1,296,628 | 3/1919 | Cooney . | |
| 1,705,068 | 3/1929 | Sadtler . | |
| 1,742,423 | 1/1930 | Stern . | |
| 2,081,380 | 5/1937 | Nachreiner . | |
| 2,142,692 | 1/1939 | Kuppers . | |
| 2,381,014 | 8/1945 | Thornley . | |
| 2,741,910 | 4/1956 | Thornley . | |
| 2,816,435 | 12/1957 | Donahue | 52/260 |
| 3,159,899 | 12/1964 | Pafenberg . | |
| 3,382,634 | 5/1968 | Shaw | 52/253 |
| 3,563,044 | 2/1971 | Gerwick, Jr. . | |
| 3,581,508 | 6/1971 | Junius . | |
| 3,638,378 | 2/1972 | Russ, Jr. . | |
| 3,810,339 | 5/1974 | Russo . | |

FOREIGN PATENT DOCUMENTS

| | | | |
|---|---|---|---|
| 2022787 | 11/1971 | Fed. Rep. of Germany . | |
| 2920044 | 11/1980 | Fed. Rep. of Germany | 52/260 |
| 1080764 | 6/1954 | France . | |
| 1583346 | 1/1981 | United Kingdom . | |
| 1057600 | 11/1983 | U.S.S.R. . | |

*Primary Examiner*—John E. Murtagh
*Attorney, Agent, or Firm*—Warren B. Kice

[57] ABSTRACT

A foundation piling system in which pilings are used to support a foundation system in soil having a varied composition and moisture content. The pilings extend into concrete grade beams forming a portion of a monolithic system including a concrete slab. Flanges extend from the end portions of the pilings that are disposed in the grade beam and a plurality of horizontally extending reinforcing bars extend through openings in the flanges.

13 Claims, 1 Drawing Sheet

FOUNDATION PILING SYSTEM

BACKGROUND OF THE INVENTION

This invention relates to a foundation piling system, and more particularly to such a system which enjoys improvements over conventional foundation supports for houses, buildings and the like.

In home and building construction, exterior grade beams, or footings, are often utilized which are formed in ditches, or the like, to support the exterior walls of the building. These concrete grade beams are often poured in conjunction with a continuous slab which extends in the area between the grade beams and can be poured simultaneously with, or separate from, the grade beams.

However, problems are encountered in connection with these type arrangements, especially when the building site contains soil of varying compactness and plasticity. For example, in cases when a building site is extensively graded to level it and soil is moved from one portion of the lot to the other, the soil immediately underneath the removed soil is relatively compact while the soil that is moved to other portions of the building site is relatively loose. This, of course, causes differential movements of the foundation and the grade beams and potential problems with regard to cracking, breaking, or the like.

Several techniques have been suggested to combat these problems. For example, a concrete pier system has been suggested in which relatively deep holes are formed and concrete poured into the holes to form a pier for the exterior grade beam. However, these concrete piers have several disadvantages. For example, the depth to which the beam is formed is often based on a single soil test at one area which is not necessarily representative of the entire area. Thus the pier, although adequate in height for the particular area tested, may be insufficient to adequately support the foundation in other areas having a softer or more plastic soil composition.

Also, the drills used to drill the pier holes do not necessarily clean out the bottom of the holes which causes difficulty in the stability of the beam once it has been poured. Further, the pier drill may encounter soft rock strata or the like which jams the drill and causes undue delays. Still further, upheaval forces, i.e., forces in the upward direction often occur due to the changes in the wetness or the dryness of the soil which causes a poured concrete pier to fail. Still further, in soils having a large percentage of clay there is a certain practical limit on the height of the pier, which does not necessarily support the foundation adequately in this type of environment.

Other techniques for constructing an adequate exterior grade beam support include a post tension technique in which cables are passed through the forms for the grade beams and, after the concrete is poured thereover, are placed in very high tensile stress to increase the resistance of the foundation to cracking or failing. However, these types of techniques require a great deal of labor and are also subject to fail.

SUMMARY OF THE INVENTION

It is therefore an object of the present invention to provide a foundation piling system in which pilings are used which will support a foundation system in soil having a varied composition and moisture content.

It is a further object of the present invention to provide a system of the above type which eliminates the need for drilling a hole in the ground to receive the pilings.

It is a still further object of the present invention to provide a system of the above type in which the pilings are formed of steel pipes.

It is a further object of the present invention to provide a system of the above type in which the pilings extend into concrete grade beams forming a portion of a monolithic system including a concrete slab.

It is a still further object of the present invention to provide a system of the above type in which a cap extends over the upper end of the pilings and has a pair of flanges extending therefrom which receive reinforcing bars for the concrete grade beams, to add stability and strength to the foundation.

Towards the fulfillment of these and other objects the present invention provides a foundation piling system in which pilings are used to support a foundation system in soil having a varied composition and moisture content. The pilings extend into concrete grade beams forming a portion of a monolithic system including a concrete slab. Flanges extend from the end position of the pilings that are disposed in the grade beam and a plurality of horizontally extending reinforcing bars extend through openings in the flanges.

BRIEF DESCRIPTION OF THE DRAWINGS

The above brief description as well as further objects, features and advantages of the present invention will be more fully appreciated by reference to the following detailed description of presently preferred but nonetheless illustrative embodiments in accordance with the present invention when taken in conjunction with the accompanying drawings wherein.

DESCRIPTION OF THE PREFERRED EMBODIMENT

Figure 1:
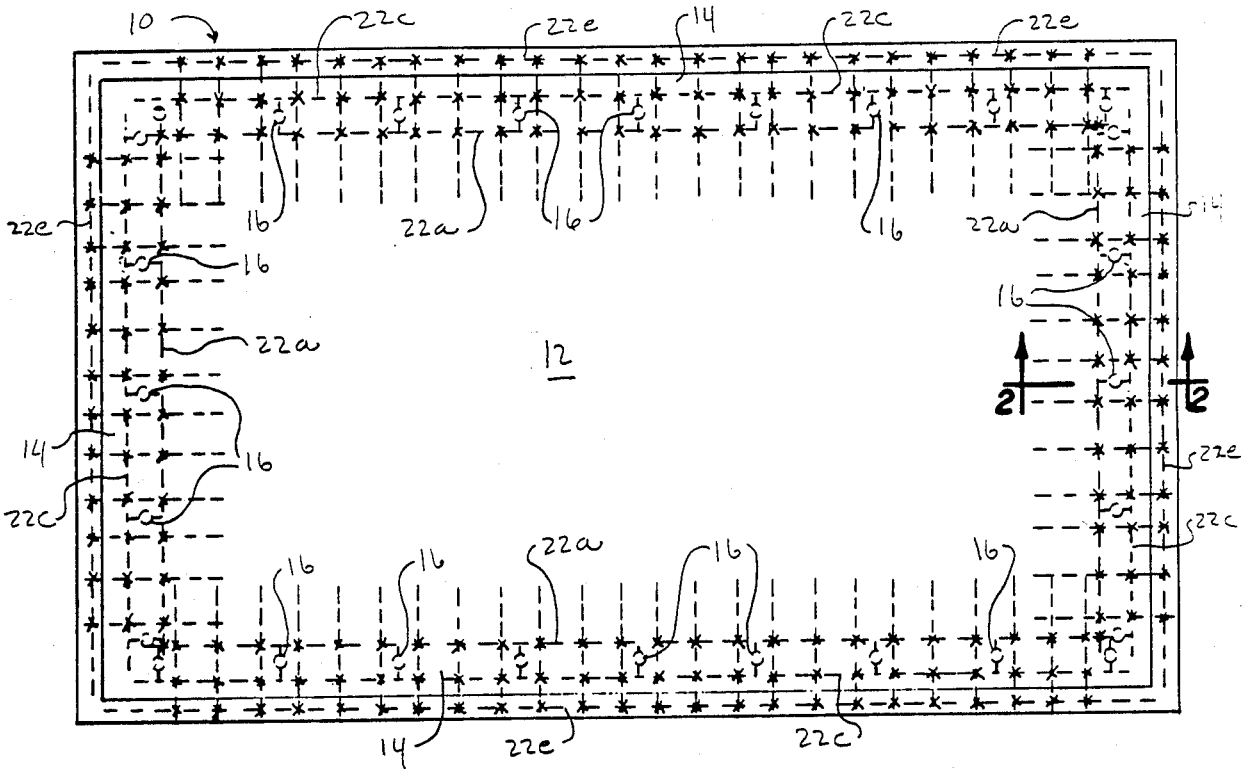
FIG. 1 is a plan view depicting a portion of the foundation piling system of the present invention.
Figure 2:
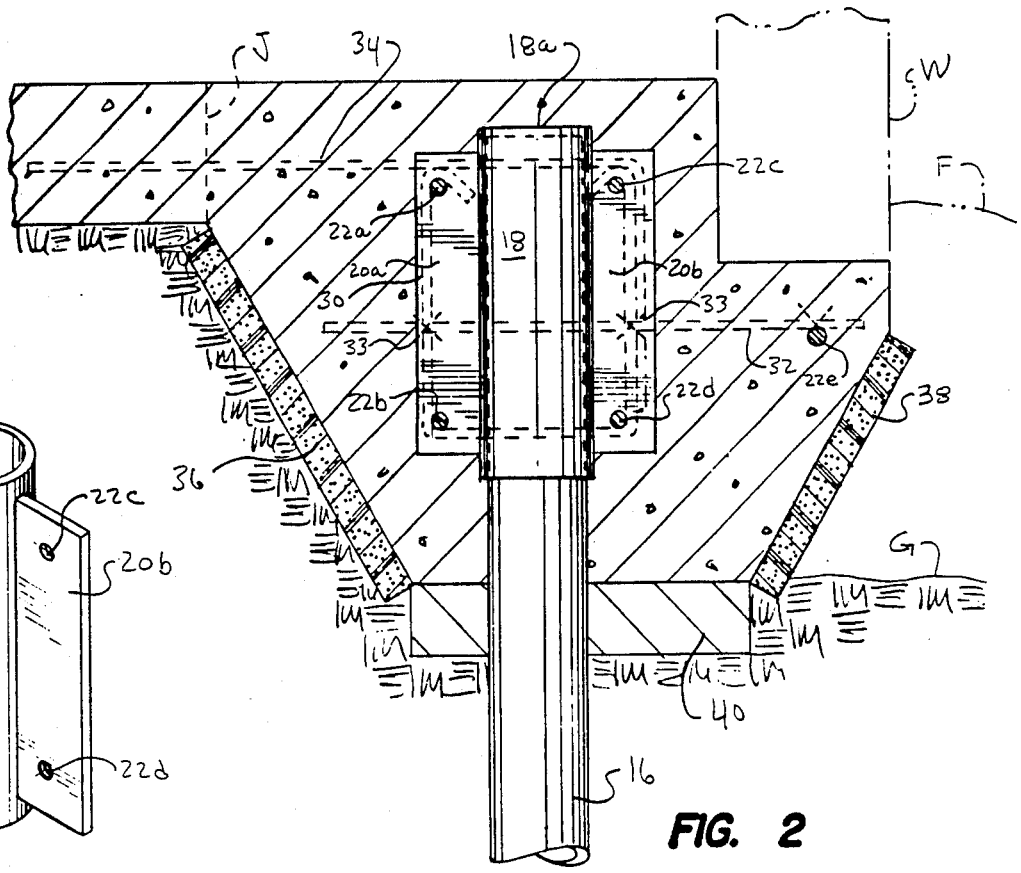
FIG. 2 is an enlarged sectional view taken along the line 2—2 of FIG. 1.

Referring to FIGS. 1 and 2 of the drawings, the reference numeral 10 refers in general to the foundation system of the present invention which consists essentially of a concrete slab 12 formed in a rectangular configuration and having a grade beam 14 extending around the margins thereof. The grade beam 14 is formed essentially of concrete and can be formed integrally with the slab 12. Alternatively, the grade beam 14 can be formed separately from the slab 12 in which case, a joint J (FIG. 2) would be formed at the interface between the grade beam and the slab. The upper surface of the grade beam 14 is coextensive with the upper surface of the slab 12 and the grade beam has a height, or thickness, greater than that of the slab.

Figure 3:
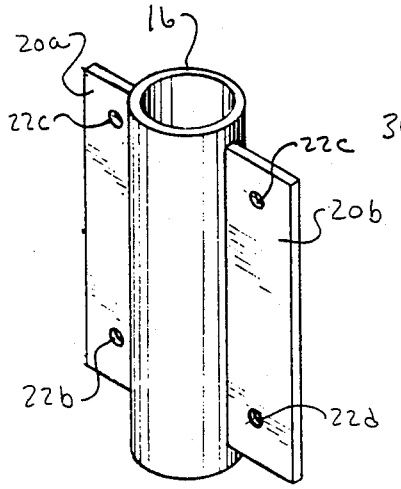
FIG. 3 is an enlarged perspective view of a component of the system of FIGS. 1 and 2.

A plurality of vertical steel pilings 16 extend from the grade beam 14 and into the ground and are spaced at pre-determined intervals, such as nine feet. A sleeve 18 extends over the upper end portion of each piling 16 and has a top cap, or cover 18*a* which rests on the upper end of the piling. As shown in FIGS. 2 and 3 a pair of ears, or flanges, 20*a* and 20*b* extend from diametrically opposite portions of each sleeve 18 and are connected thereto in any conventional manner. A pair of vertically spaced through openings are provided through each flange 20*a* and 20*b* for reasons to be described.

Four horizontally-extending steel bars 22*a*, 22*b*, 22*c* and 22*d* are provided in the grade beam 14 and extend in two rows of two bars per row. The bars 22*a* and 22*b* extend parallel in a vertically-spaced, parallel relationship and through corresponding aligned openings in the flanges 20*a*, and the bars 24 and 26 extending in a vertically-spaced, parallel relationship and through corresponding aligned openings in the flanges 20*b*. The bars 22*a* and 22*b* are thus horizontally-spaced from the bars 22*c* and 22*d*, respectively and the bars 22*a* and 22*c* are vertically-spaced from the bars 22*b* and 22*d*, respectively.

An additional bar 22*e* is provided which is located adjacent the outer margin of the horizontally extending grade beam 14 in a spaced relation to the other bars 22*a*–22*d*. Each of the bars 22*a*–22*e* extends continuously along the grade beam 14 in a substantially rectangular configuration and each can be formed by a plurality of sections which are overlapped and connected together before the grade beam 14 is poured.

A plurality of U-shaped stirrups 30 (FIG. 2) extend around the bars 22*a* and 22*d* at predetermined spaced intervals along the grade beam 14, such as three feet. The upper end portions of each stirrup 30 are bent inwardly to secure each stirrup to the bars 22*a* and 22*c*. A plurality of parallel, horizontally-extending dowels 32 extend transversly to the pilings 16 and to the bars 22*a*–22*e* and are also spaced at three feet intervals. The dowels 32 are tied to the bar 22*e* and to the stirrups 30 by tiewires 33 prior to pouring of the concrete.

A plurality of parallel, horizontally-spaced L-shaped dowels 34 extend over the bent portion of the stirrups 30 and in an abutting relationship with a vertical leg of a stirrups 30, respectively. The dowels 34 can be tied to their respective stirrups 30 by tiewires (not shown) if necessary.

The inner and outer side walls of the grade beam 14 are tapered inwardly and a pair of styrofoam strips 36 and 38 are disposed adjacent the latter walls, respectively, and serve to insulate the foundation from the moisture and temperature of the soil surrounding same. A corrugated cardboard filler 40 is disposed at the bottom of the grade beam 14 and acts to absorb any upheaval forces from the soil acting against the grade beam.

According to a preferred embodiment, the piling 16 are formed by a plurality of 12 feet sections of 3 inch diameter upset seamless steel tubing preferably of a type N-80 quality (high carbon alloy steel) having a tensile stress limit of approximately 180,000 lbs. Adjacent sections of the piling are connected by a connector tube (not shown) one foot in length and $2\frac{3}{8}$ inches in diameter, with the connector tube being welded to the inner surfaces of the corresponding ends of adjacent piling sections and extending in the ends thereof.

The bars 22*a*–22*e*, the dowels 32 and 34, and the stirrups 30 can be fabricated of steel and can be sized anywhere from a number three to a number five bar, which is standard nomenclature in the industry.

In the construction of the foundation system of the present invention, the pilings 16 are driven into the ground after a 12–24 inch starter joint (not shown) is placed in the ground. A plug is inserted in the starter joint to provide a solid bearing member and to keep the soil from traveling up the joint after it is driven into the ground. The pilings 16 are driven by a conventional pile driver into the ground until absolute refusal is encountered, i.e. until the pilings 16 cannot be driven any further into the ground; or to practical refusal when a piling does not stop driving but yet is at a depth sufficient to support well in excess of the static load of the foundation system 10 and the house.

During the driving of the pilings 16 into the ground, a pressure bulb is formed by the compacting soil which further adds to the stability of the pilings 16 and this, along with the skin friction of the pilings, can support the foundation system 10 and the house. Alternatively, the pilings 16 can be driven with a predetermined amount of energy which can be calculated based on the soil conditons to ensure that an adequate load strength is obtained.

After the pilings 16 have been placed around the periphery of the site at predetermined intervals, such as nine feet, the bars 22*a*–22*d* are strung through the aligned openings in the flanges 20*a* and 20*b* as shown in FIG. 2 and thus extend in a rectangular configuration as shown in FIG. 1. The other bar 22*e* is placed in the position shown along with the stirrups 30 and the dowels 32 and 34. The stirrups 30 stabilize the bars 22*a*–22*d* and the dowels 32 are tied to the stirrups 30 and to the bar 18. The styrofoam strips 36 and 38 and the cardboard 40 are placed in position and the slab 12 and the grade beam 14 poured.

The forms for the concrete are such that a shoulder 42 is formed in the outer corner of the grade beam 14 to provide a space for an exterior wall W of the building. The normal level of the ground is shown by the reference letter G, while after the foundation of the present invention is poured, fill dirt can be filled around the grade beam as shown by the reference letters F.

Several advantages result from the system of the present invention. For example, the bars 22*a*–22*d* extending through the flanges 20*a* and 20*b* which are secured relative to the pilings 16 add stability and strength to the system while the dowels 32 and 34 and the stirrups 30 not only reinforce the concrete grade beam 14, but act as stabilizers for the bars 20*a*–20*e* prior to the pouring of the concrete. Also, the pilings 16 can be driven to a great depth through several layers of soft rock strata in a fairly simple and easy manner, and due to their low surface friction, resist upheaval forces since the latter cannot "grab" the pilings and cause damage thereto. Further, the cardboard 40 provides insulation and acts as a spacer to accommodate any upheaval forces in the ground. The tapered configuration of the walls of the grade beam 14 prevents any upheaval on the foundation 12 and causes a shear at the base of the grade beam 14 of any soil tending to move upwardly due to swelling or the like.

It is understood that several variations may be made in the foregoing without departing from the scope of the invention. For example in situations where an extremely deep strata may be penetrated, an I beam or an H-beam of mild steel may be utilized as a piling which encounters less resistance on the driven end than the tubular pilings 16. In this case the bars would be inserted through appropriate holes formed in the flanges of the I-beams or welded to the side edges thereof.

Also, in the event that 50% or more of the grade is formed by fill dirt, horizontal grade beams on twelve feet centers can be formed through the slab extending both longitudinally and traversely to add further strength to the system. As a further option, number three steel bars on sixteen inch centers can be formed through the slab 12 to form a steel mat in the center of the slab to add further strength.

It is noted that the system of the present invention is not limited to the particular foundation disclosed but is equally applicable to a floating slab, a standard pier and beam, or supporting slab system, all conventional in the art.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention therein.

What is claimed is:

1. A foundation system for a building, comprising a plurality of piling members extending into the ground and having a portion projecting from the ground, two flanges extending from diametrically opposite portions of the projecting portion of each of said piling members, each flange having at least two openings extending therethrough, four horizontally extending bar members respectively extending through said openings, said bar members being formed in two spaced rows of two bar members per row, said rows being spaced horizontally and the bar members of each row being spaced vertically, a substantially U-shaped stirrup bar extending around said bar members and within said grade beam, and a concrete structure extending over said projecting portions of said piling members said stirrups and said bar members.

2. The foundation system of claim 1 wherein said concrete structure comprises a slab and grade beam extending around the margins of said slab and having a height greater than that of said slab for supporting the walls of said building.

3. The foundation system of claim 2 wherein said grade beam is integral with said slab.

4. The foundation system of claim 2 wherein each bar member extends throughout said grade system.

5. The foundation system of claim 2 wherein each bar member is formed into a rectangular configuration.

6. The foundation system of claim 1 further comprising a pair of horizontally extending dowels extending from said stirrup bar and within said grade beam.

7. A foundation system for a building, comprising a plurality of piling members extending into the ground and having a portion projecting from the ground, a sleeve extending over and connected to the projecting portion of each of said piling member, at least one flange extending from said sleeve, said flange having at least one opening extending therethrough, at least one horizontally extending bar member extending through said openings, and a concrete structure extending over said projecting portion of said piling members, said sleeve, and said bar member.

8. The foundation system of claim 7 wherein there are two flanges extending from diametrically opposite portions of said sleeve.

9. The foundation system of claim 8 wherein there are two openings extending through each of said flanges, and wherein four bars members extend through the respective aligned openings of said flanges.

10. The foundation system of claim 7 wherein said concrete structure comprises a slab and grade beam extending around the margins of said slab and having a height greater than that of said slab for supporting the walls of said building.

11. The foundation system of claim 10 wherein said grade beam is integral with said slab.

12. The foundation system of claim 10 wherein each bar member extends throughout said grade system.

13. The foundation system of claim 10 wherein each bar member is formed into a rectangular configuration.

* * * * *